US010288397B2

(12) United States Patent
Rastegar et al.

(10) Patent No.: US 10,288,397 B2
(45) Date of Patent: May 14, 2019

(54) METHODS AND DEVICES FOR GUIDANCE AND CONTROL OF HIGH-SPIN STABILIZED ROUNDS

(71) Applicants: Jahangir S Rastegar, Stony Brook, NY (US); Jacques Fischer, Sound Beach, NY (US)

(72) Inventors: Jahangir S Rastegar, Stony Brook, NY (US); Jacques Fischer, Sound Beach, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 134 days.

(21) Appl. No.: 15/480,322

(22) Filed: Apr. 5, 2017

(65) Prior Publication Data

US 2017/0268859 A1 Sep. 21, 2017

Related U.S. Application Data

(63) Continuation of application No. 14/822,897, filed on Aug. 10, 2015, now abandoned.

(60) Provisional application No. 62/035,483, filed on Aug. 10, 2014.

(51) Int. Cl.
*F42B 10/64* (2006.01)
*F42B 17/00* (2006.01)

(52) U.S. Cl.
CPC ..... *F42B 17/00* (2013.01); *F42B 10/64* (2013.01)

(58) Field of Classification Search
CPC ..... F42B 10/14; F42B 10/16; F42B 10/18; F42B 10/20; F42B 10/26; F42B 10/62; F42B 10/64
See application file for complete search history.

(56) References Cited

U.S. PATENT DOCUMENTS

| | | | | |
|---|---|---|---|---|
| 2002/0117580 | A1* | 8/2002 | Rupert | F42B 10/50 244/3.24 |
| 2011/0073705 | A1* | 3/2011 | Huguenin | F42B 10/64 244/3.24 |
| 2011/0180655 | A1* | 7/2011 | Deschatre | F42B 10/64 244/3.28 |
| 2014/0209732 | A1* | 7/2014 | Pettersson | F42B 10/14 244/3.23 |
| 2014/0224922 | A1* | 8/2014 | Rastegar | F42B 15/01 244/3.22 |

* cited by examiner

*Primary Examiner* — Stephen Johnson

(57) ABSTRACT

A method for deploying a control surface from an exterior surface of a spinning projectile during flight is provided. The method including: at least partially retracting the control surface into an interior of the projectile for a portion of a full revolution of the spinning projectile and extending the control surface from the interior of the projectile for another portion of the full revolution of the spinning projectile; and maintaining the control surface in a same plane during the full revolution of the spinning projectile.

10 Claims, 11 Drawing Sheets

A Linearly Polarized RF Reference Source

Geometrical Cavity Sensor Onboard Munitions

METHODS AND DEVICES FOR GUIDANCE AND CONTROL OF HIGH-SPIN STABILIZED ROUNDS

CROSS-REFERENCE TO RELATED APPLICATIONS

This application is a Continuation Application of U.S. application Ser. No. 14/822,897 filed on Aug. 10, 2015, which claims benefit to U.S. Provisional Application No. 62/035,483 filed on Aug. 10, 2014, the entire contents of each of which are incorporated herein by reference.

BACKGROUND OF THE INVENTION

1. Field of the Invention

The present invention relates generally to guidance and control systems, and more particularly, to methods and devices for providing guidance and control of low and high-spin rounds.

2. Prior Art

Guidance and control of high-spin stabilized rounds presents major challenges. These challenges may be divided into two basic categories. The first category includes the need for onboard sensors for direct and precise measurement of the round orientation, particularly in roll, for generating the required control action. The need for precise roll angle measurement is particularly critical for relatively short range direct fire applications and for targeting during the terminal guidance phase of larger frame munitions such as smart artillery and mortars. The second category of challenges is related to the need for actuation devices that are very low volume, do not rely on de-spinning of the entire or a section of the round, can provide short duration actuation for terminal guidance and occasional mid-flight course correction as well as for continuously applied control action for longer range munitions and dynamic retargeting, and that can operate at spin rates of 200 Hz and possibly higher.

Since the introduction of 155 mm guided artillery projectiles in the 1980's, numerous methods and devices have been developed or are under development for guidance and control of subsonic and supersonic rounds. These include different technologies and related components such as actuation devices, position and angular orientation sensors, and guidance and control hardware and algorithms. The majority of these devices have been developed based on missile and aircraft technologies, which are in many cases difficult or impractical to implement on gun-fired projectiles and mortars. This is particularly true in the case of actuation devices, where electric motors of various types, including various electric motor designs with or without gearing, voice coil motors or solenoid type actuation devices used directly to actuate control surfaces have dominated the guidance and control of most guided weaponry. Thrusters of various types have also been successfully employed. However, currently available thrusters are suitable only for low or no-spin rounds due to their limitations in terms of relatively long pulse widths and unpredictable actuation delays as well as the required large volume and surface area that needs to be covered to achieve enough number of actuation impulses that are needed for high-spin round control action even for one second of actuation control for terminal guidance purposes. Other currently available actuation technologies developed for munitions applications are suitable for non-spinning rounds or for rounds with very low spinning rates.

Current guidance and control technologies and those under development are not effective for flight trajectory correction/modification of high-spin guided munitions. Such spin stabilized rounds may have spinning rates of 200 Hz or higher, which pose numerous challenging sensing, actuation and control force generation and control algorithm and processing issues that need to be effectively addressed using innovative approaches. In addition, unlike missiles, all gun-fired spinning rounds are provided with initial kinetic energy through the pressurized gasses inside the barrel and are provided with flight stability through spinning and/or fins. As a result, they do not require in-flight control action for stability and if not provided with trajectory altering control actions, such as those provided with control surfaces or thrusters, they would simply follow a ballistic trajectory. This is still true if other means such as electromagnetic forces are used to accelerate the projectile during the launch or if the projectile is equipped with range extending rockets. As a result, unlike missiles, control inputs for guidance and control is required only later during the flight and in many cases as the projectile approaches the target.

In recent years, alternative methods of actuation for flight trajectory correction have been explored, some using smart (active) materials such as piezoelectric ceramics, active polymers, electrostrictive materials, magnetostrictive materials or shape memory alloys, and others using various devices developed based on micro-electro-mechanical (MEMS) and fluidics technologies. In general, the available smart (active) materials such as piezoelectric ceramics, electrostrictive materials and magnetostrictive materials (including various inch-worm designs and ultrasound type motors) need to increase their strain capability by at least several orders of magnitude to become potential candidates for actuation applications for guidance and control, particularly for gun-fired munitions and mortars. In addition, even if the strain rate problems of currently available active materials are solved, their application to gun-fired projectiles and mortars will be very limited due to their very high electrical energy requirements and the volume of the required electrical and electronics gear. Shape memory alloys have good strain characteristics but their dynamic response characteristics (bandwidth) and constitutive behaviour need significant improvement before becoming a viable candidate for actuation devices in general and for munitions in particular, even those with very low spin rates.

All currently available actuation devices based on electrical motors of various types, including various electrical motor types, voice coil motors and solenoids, with or without different gearing or other mechanical mechanisms that are used to amplify motion or force (torque), and the aforementioned recently developed novel methods and devices (based on active materials, such as piezoelectric elements, including various inch-worm type and ultrasound type motors), or those known to be under development for guidance and control of airborne vehicles such as missiles, suffer from the basic shortcoming of not being capable of providing the dynamic response levels that are required for guidance and control of high-spin rounds with spin rates of up to 200 Hz or higher. This fact is readily illustrated by noting that, for example, a round spinning at 200 Hz would undergo 72 degrees of rotation in only 1 msec. This means that if the pulse duration is even 1 msec and its unpredictable initiation time (pulse starting time) is off by 1 msec, then the direction of the effective impulse acting on the round could be off by over 90 degrees, i.e., when a command is given to divert the round to the right, the round may instead be diverted up or down. Such a level of uncertainty in the "plant" (round) trajectory correction response makes even the smartest feedback control system totally ineffective.

For guidance and control system of all gun-fired munitions and in particular high-spin rounds in which even the problematic de-spinning options are not practical, the only feasible actuation options are either the proposed high-precision and very short duration impulse based actuation devices or the proposed intermittently deployed control surface or drag element based actuation devices. For guidance and control system of all high-spin rounds as well as for terminal guidance of all gun-fired munitions and mortars, the most important sensory input is that of the roll angle measuring sensor. Roll angle measurement in munitions has been a challenge to guided munitions designers in general and for high-spin rounds in particular. The currently available laser gyros are impractical for use in munitions due to size, cost and survivability as well as for initialization of the roll angle measurement. Magnetometers are also impractical since they can only measure angle in two independent directions, which may not be aligned for roll angle measurement at all times during the flight. Their angle measurement is also not precise and requires a local map and is susceptible to environment in the field. Inertial based gyros may be used, but require initiation at regular time intervals to overcome initial settling and drift issues.

In summary, the currently available guidance and control systems and their components suffer from one or more of the following major shortcomings that make them impractical for application to high-spin guided munitions:

1. Limited dynamic response: The munitions with high spin rates demand control actuation systems that can provide either very short duration (sub-millisecond) impulses or intermittently deployed control surface or drag producing elements with very precise timing in order for the control action to be applied over a limited range of munitions roll angle. For example when an impulse type actuation device is being used in a round spinning at 200 Hz, if the control actuation is to be applied over a 10 degrees range of roll angle, then the control actuation must be applied for only around 0.14 milliseconds, or at an equivalent frequency of around 7,200 Hz. This would obviously eliminate any of the aforementioned currently available actuation devices for such high-spin round guidance and control applications, even in the presence of a highly precise roll angle measurement sensor.
2. Impulse type actuation timing and duration: In addition to the above dynamic response limitations, the fastest thruster or impulse type guidance and control actuation devices that are currently available suffer from two basic shortcomings: (1) actuation impulse timing precision; and (2) impulse width precision. The first shortcoming is mainly due to unpredictable delays in the initiation devices, while the second shortcoming is mainly due to the relatively long pulse durations in currently available impulse generator and thruster technologies.
3. Control surface and drag-based actuation device: Current control surface based as well as drag-based actuation devices are usually used in either non-spinning rounds or are mounted in a de-spun section of an otherwise spin stabilized round, which are either impractical or highly costly in terms of volume and power requirements in high-spin rounds. Intermittently deployed drag generating elements have been used in spinning rounds but not with high spin rates. Drag generation based control is however highly inefficient since it would reduce the munitions range. In addition, currently studied and available drag-based devices using solenoids and voice coil motors consume large amounts of power and are problematic in terms of dynamic response, volume requirement and survivability.
4. Roll angle measurement: An effective guidance and control technology for high-spin rounds requires sensors for onboard measurement of the projectile roll angle. The roll angle sensor has to provide the required precision and should not be subject to drift or other similar effects that over time during the flight causes error to accumulate and render roll angle measurement unreliable. It is also appreciated that one may use roll angle sensors that are subject to drift and exhibit relatively long settling times, but in such cases, appropriate means have to be provided for initialization of the sensors at regular time intervals.
5. High power requirement: All currently used actuation mechanisms working with electrical motors and/or solenoids of different types as well as actuators based on active materials, such as piezoelectric materials and electrostrictive materials and magnetostrictive materials (including various inch-worm designs and ultrasound type motors) and shape memory based actuator designs, are only applicable to munitions with low spin rates. But even in such applications, they demand high electrical power for their operation.
6. Occupy large munitions volume: One solution that has been employed or has been considered for high-spin guidance and control has been de-spinning the entire round or a section of the round where the control surfaces or the like are positioned. As a result, the aforementioned dynamic response issues are resolved. Such solutions are, however, impractical for medium caliber munitions due to the lack of space to provide the means to de-spin the round. Such solutions are practical for larger caliber rounds, but even for these cases they are highly undesirable for the following reasons. Firstly, the actuation devices and mechanisms required for de-spinning occupy a significant portion of the round volume. The available volume for payload is also further reduced since fins or other stabilizing means must also be provided to ensure stable flight. As a result, the weapon lethality is significantly reduced. In addition, a significant amount of power has to be provided for de-spinning of the round.
7. High cost of the existing technologies, which results in very high-cost rounds, thereby making them impractical for large-scale fielding.
8. Relative technical complexity for the implementation of the current guidance and control technologies for high-spin rounds such as for de-spinning of the entire round or its guidance and control section, which results in increased munitions cost.

SUMMARY OF THE INVENTION

The methods and devices disclosed herein for guidance and control of high-spin stabilized munitions include two classes of novel actuation devices that are particularly suitable for high-spin rounds. The first class of actuation concepts is based on detonation of small amounts of charges to achieve short duration impulses with highly predictable timing and duration. The second class of actuation concepts is highly innovative and provides intermittently deployed control-surface-based control action that are driven by electric motors with rotary speeds that are a fraction of the spin rate of the round. The deployed control surfaces provide control action over a large range of roll cycle while adapting to the roll angle positioning of the round to maximize control action performance. The intermittent control surface deployment mechanism may also be used to deploy drag-based control elements in place of commonly used solenoids with orders of magnitude increase in efficiency and dynamic response as well as with orders of magnitude reduction in power consumption due to the use of continuously rotating and balanced electric motors.

The control methods and devices disclosed herein for guidance and control of high-spin stabilized munitions also includes polarized RF sensors with electronic scanning reference sources for onboard direct and precision measurement of roll angle for control action timing and magnitude control. The provision of onboard and precision roll angle information provides the means to maximize the effectiveness of the applied control action and minimize the actuation system size and power requirements. Also provided is the related control algorithms that would account for issues that are specific to high-spin rounds for achieving optimal control action.

Not included in this disclosure are concepts that require de-spinning of the entire or a section of the round since such concepts have been shown to occupy a significant volume of the round, thereby significantly reduce lethality; require a very large amount of power to operate; are very costly to implement; and are generally impractical for medium caliber munitions.

The guidance and control methods and devices disclosed herein for guided high-spin munitions provide the following novel features and basic characteristics:

1. Provide novel integrated guidance and control technology concepts that would address all major challenges that are currently facing guided munitions designers for high-spin rounds, including provision of two novel classes of actuation concepts and sensors for direct and precision measurement of roll angle for closing feedback guidance and control loop.
2. For control action, two novel classes of concepts, one impulse-based and the other based on intermittent deployment of control surfaces (or drag producing elements) are proposed.
3. The first class of actuation concepts are based on detonation of small amounts of charges to achieve short duration impulses with highly predictable timing and duration. Unlike commonly used thrusters in munitions, this class of impulse based actuation devices are multistage, thereby occupying a fraction of munitions volume and surface area for a desired number of actuation impulses. This class of actuation device concepts provide very short duration impulses with very high timing precision and repeatability—of the order of 100-200 microsecond duration. The proposed impulse-type actuation devices can provide impulses equivalent (several pulses in one second) of 10 N-sec to 140 N-sec for up to 2 milliseconds. For the development of the detonation charges and its integration into the present impulse type actuation devices, Omnitek has teamed up with Hanley Industries, a leading developer and manufacturer of explosive charges and devices.
4. The second class of actuation concepts are highly innovative and provide intermittently deployed control surfaces. This class of actuation devices are powered by electric motors without requiring de-spinning of the entire or even a section of the round. One of the novel features of this class of intermittently deployed control surface actuation devices is the capability of the actuation mechanisms to be driven by electric motors that run at a fraction of the spin rate of the round, thereby making them suitable for very high spin rate applications. For example, the driving electric motor of several of such proposed concepts can be driven at less than one tenth of the sound spin rate, thereby requiring readily achievable motor speeds of around 20 Hz (1,200 rpm) for a round spinning at 200 Hz (12,000 rpm). When desired, the mechanisms for intermittent deployment of control surfaces may also be used to deploy drag-based control elements instead of commonly used solenoids, thereby significantly increasing their dynamic response while significantly reducing the size and power requirement due to continuously rotating driving electric motors.
5. Provide onboard sensors for direct and precision measurement of the round roll angle to enable munitions guidance and control system to precisely time the required control action for trajectory correction/modification. For indirect fire applications where pitch and yaw angles may also be required for guidance and control purposes, the proposed angular orientation sensors can also be used for their direct measurements. The sensors can also be used for onboard position measurement without requiring GPS signals. The sensory system is provided with innovative scanning reference sources that can also be used to set up a full local position and orientation referencing system for guided munitions, weapon platforms, target designation, as well as for soldiers.
6. The two detonation-based actuation concepts provide high impulse levels with very short durations and with minimal unpredictable impulse initiation and duration times to provide control action for flight trajectory correction and/or modification for high-spin munitions. The two concepts integrate a novel and very fast and low power electrical initiation technology with multi-shot detonation based impulse units to achieve very fast acting and short duration impulses that can be timed with appropriate precision to provide control action for the proposed novel guidance and control technology.
7. The intermittently deployable control surface actuation methods and devices disclosed herein provide "quasi-continuous" control action with pitch control. They are driven by continuously rotating electric motors that operate at speeds that are a fraction of the round spin rate, thereby making them suitable for spin rates of 200 Hz or even higher. When desired, these intermittently deployed control surface concepts may be used to generate lift type control action to minimally affect munitions range or may be used to generate drag to generate aerodynamic forces/torques.
8. The impulse-based actuation devices require a fraction of one mJ of electrical energy to operate for each impulse shot. The power requirement for the intermittently deployed control surface based actuation devices is also orders of magnitude less than currently used electrical motor or solenoid driven actuation devices since they are driven mostly at nearly constant rates, can be dynamically balanced to require minimal force/torque to operate. The onboard polarized RF roll angle sensors also require low power to operate since they are not required to make continuous roll angle measurement since their measurement is direct and free of error accumulation.
9. The actuation devices disclosed herein can be readily hardened to survive setback shock loading of well over 50 KG. The two detonation-based actuation concepts are essentially integrated into the structure of the munitions as load-bearing structures, thereby occupy minimal added volume and can be designed to withstand shock of well over 50 KG. The intermittently deployed control surface based actuators use very small electric motors, similar to which have already been used in gun-fired munitions. The control surfaces as well as their deployment mechanisms are locked in placed during the launch and deployed later during the flight.

10. The actuation device methods and devices are very simple in design, and are constructed with relatively few moving parts, thereby making them highly reliable even following very long storage times of over 20 years.
11. The actuation device methods and devices are very simple in design and utilize existing manufacturing processes and components. As a result, the proposed actuation devices should provide the means to develop highly effective but low cost guidance and control systems for high-spin guided gun-fired projectiles.
12. The guidance and control methods and devices, including their actuation devices and roll angle sensors, are shown to be scalable to medium as well as large caliber munitions.
13. All components of the disclosed guidance and control methods and devices, including their actuation devices and roll angle sensor electronics, have been used in munitions and have been shown to operate in the temperature range of −65 to 165 degrees F.
14. The guidance and control actuators can be used in both subsonic and supersonic spinning projectiles.

A need therefore exists for the development of innovative, low-cost guidance and control technologies for high-spin rounds that address the aforementioned limitations of currently available technologies in a manner that leaves sufficient volume inside munitions for other components such as communications electronics and fusing, as well as the explosive payload to satisfy the lethality requirements of the munitions. The critical enabling technologies for guidance and control of high spin munitions are those related to precision roll angle measurement and to actuation devices that can provide control action without requiring a section of the round to be de-spun.

Such guidance and control technologies must consider the relatively short flight duration for most gun-fired projectiles and mortar rounds, which leaves a very short period of time within which trajectory correction/modification has to be executed. Even for longer range munitions, even though some control action may be desirable in mid-flight but it is mostly required for terminal guidance.

This means that for impulse based control actuation, such devices must be capable of providing either very short duration impulse-based actuation (of the order of 100-200 microseconds for spin rates of around 200 Hz) at precisely prescribed and repeatable roll angles—preferably within a range of less than 10 degrees. This requirement translates to relatively large impulses of the order of 10 N-sec to 140 N-sec for 100-200 microseconds for spin rates of around 200 Hz and up to 2 milliseconds for low spin rates of 10-20 Hz. In addition, to achieve an effective guidance and control system for high-spin rounds, the system roll sensor must also be very accurate (precision of the order of 1-2 degrees or better) to be capable of providing initiating and/or synchronization timing for the impulse actuation.

For intermittently deployed control surface and drag producing type actuation devices, current technologies require electric motors or solenoids to deploy the control element during a very small portion of the round roll, preferably at most 30-60 degrees, i.e., during $1/12^{th}$ to $1/6^{th}$ of a roll cycle. This means that the driving motor or solenoid must rotate at several times the spin rate of the round. For example, if a solenoid is used for such deployments, one cycle of solenoid action would correspond to $1/12^{th}$ to $1/6^{th}$ of the round cycle, therefore requiring a dynamic response of 2400 to 1200 Hz from the solenoid for rounds with a 200 Hz spin rate, which is not realistic to expect. Similarly high rotation rates are required for current electric motor driven intermittently deployed actuation devices.

The actuation methods and devices, the feasibility of which were studied as part of the present Phase I SKR efforts, may be divided into two distinct classes, those that are impulse based and those that are based on intermittent deployment of control surface. The latter group may also be used to deploy drag generating elements to produce the desired control action. The drag-based control action is not emphasized in the present proposal due to the aforementioned shortcoming of such devices in reducing the munitions range. The Phase I feasibility studies of this project presented later in this proposal clearly indicate the feasibility of the proposed concepts to be developed as part of the project Phase II efforts.

The guidance and control methods and devices and their components must also consider problems related to hardening of their various components for survivability at high firing setback shock loading, high spin rates and the harsh firing environment. They must also be scalable to medium caliber rounds. Reliability is also of much concern since the rounds need to have a shelf life of up to 20 years and could generally be stored at temperatures in the range of −65 to 165 degrees F.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The design and operation of the aforementioned two classes of actuation concepts for guidance and control systems of high-spin guided munitions, will now be described. The first class of actuation concepts are based on detonation of small charges to achieve short duration impulses with highly predictable timing and duration. The second class of actuation concepts provide intermittently deployed control-surface-based control action with pitch control that are driven by electric motors with rotary speeds that are a fraction of the spin rate of the round. The deployed control surfaces provide control action over a large range of roll cycle while adapting to the roll angle positioning of the round to maximize control action performance. The intermittent control surface deployment mechanisms may also be used to deploy drag-based control elements in place of commonly used solenoids with orders of magnitude increase in efficiency and dynamic response as well as with orders of magnitude reduction in power consumption due to the use of continuously rotating and balanced electric motors.

Multi-Stage Slug Shot Impulse Based Control Actuators

Figure 1:
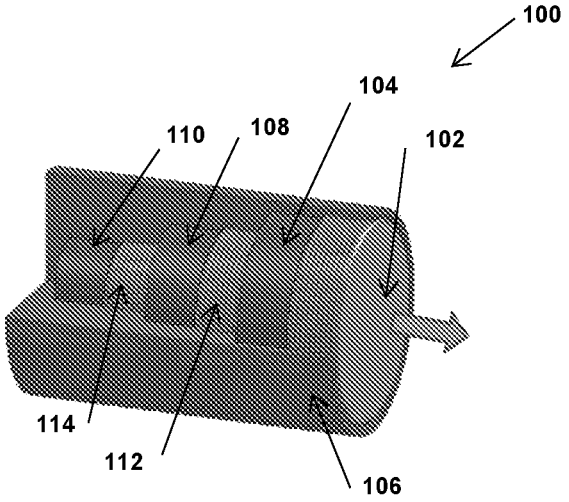
FIG. 1 illustrates a multi-stage slug-shot impulse base control actuator.

The schematic drawing of such a novel slug-shot impulse based guidance and control actuator for high-spin rounds is shown in FIG. 1 and generally referred to by reference numeral 100. To generate a very short duration shot, the endmost (largest) slug 102 is ejected by igniting the charge 104 behind it (initiator not shown in figure for the sake of clarity). The pressure of the burning propellant will rise until the threads which engage the plug 102 to the housing tube 106 fail, allowing the slug 102 to be ejected (shot) and the high-pressure propulsion charge 104 to flow into the lower-pressure surrounding atmosphere, thereby generating a very short duration and high amplitude impulse. The two remaining charges 108, 110 are protected against sympathetic initiation by the second (middle) threaded slug 112. When the next slug 112 is commanded to fire, the process will be identical to that of the first slug 102. The second slug's 112 smaller diameter will ensure that the second slug 112 does not have a long path of mangled threads to interfere with its exit path. The third slug 114 will fire and be ejected similarly.

It is noted that in FIG. 1 the diameter of the second 112 and third slugs 114 are shown to be significantly smaller than the diameter of the front slug for the purpose of clearly demonstrating the present concept. In an actual device the diameter of each slug needs to be only slightly small than those in front to clear the threaded portions that it has to pass through. In addition, less or more than three slugs may also be employed. It is also noted that the main purpose of the thread is to ensure that pressure and temperature builds up behind each slug following ignition of the charges and thereby increasing the speed of burn and increasing the level of generated impulse. A previous one-shot impulse actuation device design and testing efforts has shown that the impulse-based actuation device can provide impulses equivalent to (several pulses in one second) 10 N-sec to 140 N-sec for up to 2 milliseconds.

Solid-state electrical initiation devices with safety circuitry and logic in collaboration have been tested to show initiation of the secondary pyrotechnic material in 10-15 microseconds. Several of these miniature and very low power initiation devices can be distributed around the aforementioned detonation charges to achieve very short duration, high impulse level, reliable, and highly predictable (within a maximum of 10-15 microsecond) pulses.

Multi-Shot Impulse Thrusters Based Control Actuators

Figure 2A:
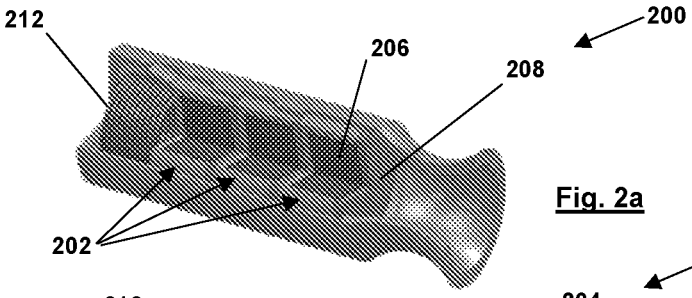
FIGS. 2*a* and 2*b* illustrate another embodiment of a multi-shot impulse actuator.
Figure 2B:
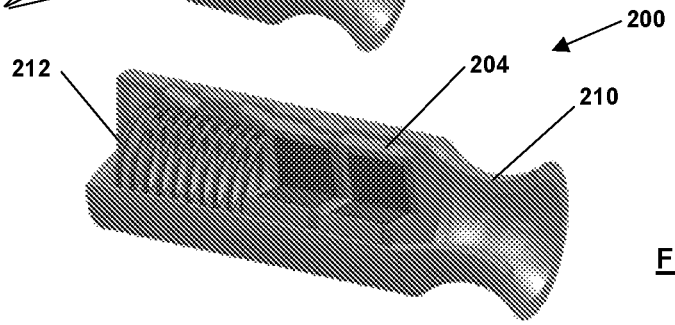

A schematic drawing of a typical multi-shot impulse thruster for guidance and control of high-spin rounds is shown in FIGS. 2*a* and 2*b*, and generally referred to by reference numeral 200. This thruster concept is a modification of the aforementioned multi-stage thruster technology. This modification is intended to significantly increase the generated impulse, decrease its duration and make it more predictable. This is accomplished as described below.

This multi-stage impulse actuation device 200 is constructed with several "impulse" units 202 (in this case three such units). Each unit 202 is packaged in a relatively solid pyrotechnic housing 204, within which is packaged the primary propellant charges 206. Each unit is capped with a relatively brittle cap 208 with scored frontal face, such that back pressure generated by the ignition of the primary propellant charges would shatter the cap into small enough pieces that could be discharged through the thruster nozzle 210. In operation, the front impulse unit is first initiated. The initiation is achieved electrically by the initiation of the aforementioned low-energy and very fast electrical initiation (not shown in FIGS. 2*a* and 2*b* for clarity), with unfolding wires provided through a side channel to each impulse unit. Following initiation of each impulse unit, the next impulse unit is pushed forward by the aft compressively preloaded spring 212, for the purpose of ensuring minimal volume space in which the gasses generated by each impulse unit have to expand, thereby increasing pressure and temperature at which the generated gasses begin to exit the nozzle 210 to produce actuation impulse. The impulse unit caps 208 have dual purpose, firstly to prevent sympathetic ignition of the next impulse units, and secondly to allow pressure and temperature rise inside the initiated impulse unit before the generated gasses are released into the nozzle volume, thereby increasing the rate of propellant burn and decreasing the generated impulse duration and to make impulse timing more predictable.

Intermittently Deployable Control Surface Concepts for Guidance and Control Actuation This class of actuation concepts are highly innovative and provide intermittently deployed control surfaces for control action. These actuators are driven by electric motors with rotary speeds that are a fraction of the spin rate of the round. The deployed control surfaces are designed to provide control action with pitch control during the flight over a large range of the munitions roll cycle while adapting to the roll angle positioning of the round to maximize control action performance. This class of actuation devices will provide a quasi-continuous fin or canard lift based control action for high-spin rounds, thereby making them suitable for short as well as longer range guided and smart gun-fired munitions without affecting their range.

The basic operation of this class of intermittently deployed control surface actuation devices in a spinning round 300 during the flight is shown in FIGS. 3*a*-3*e*. In FIGS. 3*a*-3*e* and from left to the right the round is shown during the flight during one cycle of its roll in 90 degrees rotational increments. A pointing triangle 302 drawn on the base of the round 300 indicates its relative roll angle positioning of the round 300.

Figures 3A, 3B, 3C, 3D, 3E:
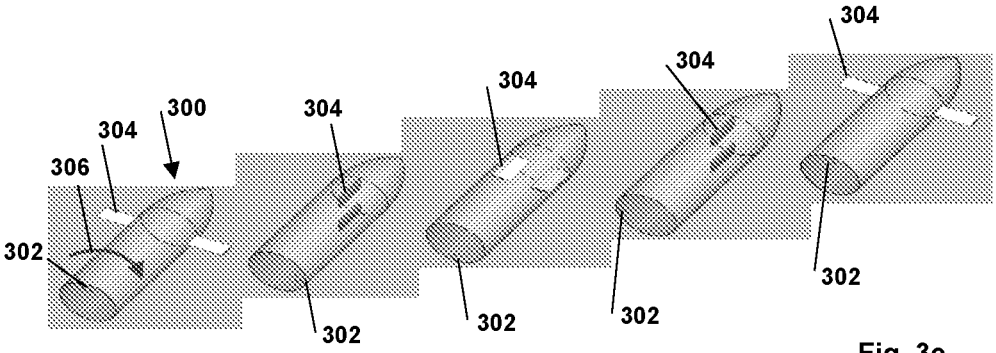
FIGS. 3*a*-3*e* illustrate an operation of intermittently deployed control surfaces for guidance and control of smart and guided high-spin rounds.

As can be seen in FIGS. 3*a*-3*e*, in the first position indicated in FIG. 3*a*, the control surfaces 304 are fully deployed. In this position, the roll angle position indicator triangle 302 on the base of the round 300 is at its up position. Then as the round 300 rotates in the clockwise direction as shown by the arrow 306 by 90 degrees to the position indicated in FIG. 3*b*, the control surface 304 is slowly retracted into the round 300. The control surfaces 304 remain retracted for 180 degrees through the roll positions indicated in FIGS. 3*c* and 3*d*. Then from the roll positioning indicated in FIG. 3*d* up to the completion of one roll cycle indicated in FIG. 3*e*, the control surfaces 304 are again deployed. As a result, during half of a full roll angle cycle, the control surfaces 304 are deployed and retracted once.

In this class of intermittently deployed actuation devices, control surfaces 304 are deployed only during a certain range of roll angle positioning of the round and are retracted during the remaining range of the roll angles. For example for the full spin cycle of FIGS. 3*a*-3*e*, the control surfaces 304 would begin to be deployed from around the roll positioning in FIG. 3*d*, providing fully deployed control surfaces 304 at the roll positioning in FIG. 3*e*. Then from the roll positioning in FIG. 3*e*—which is the same positioning indicated in FIG. 3*a*—to the roll positioning in FIG. 3*b*, the control surfaces 304 are retracted. The control surfaces 304 will then remain contracted until the indicated roll positioning at FIG. 3*d*, when the above cycle begins to be repeated.

To achieve as close to maximum performance as possible, the developed intermittently deployable control surface concepts have to provide at least one of the following two basic capabilities.

Figures 4A, 4B, 4C, 4D:
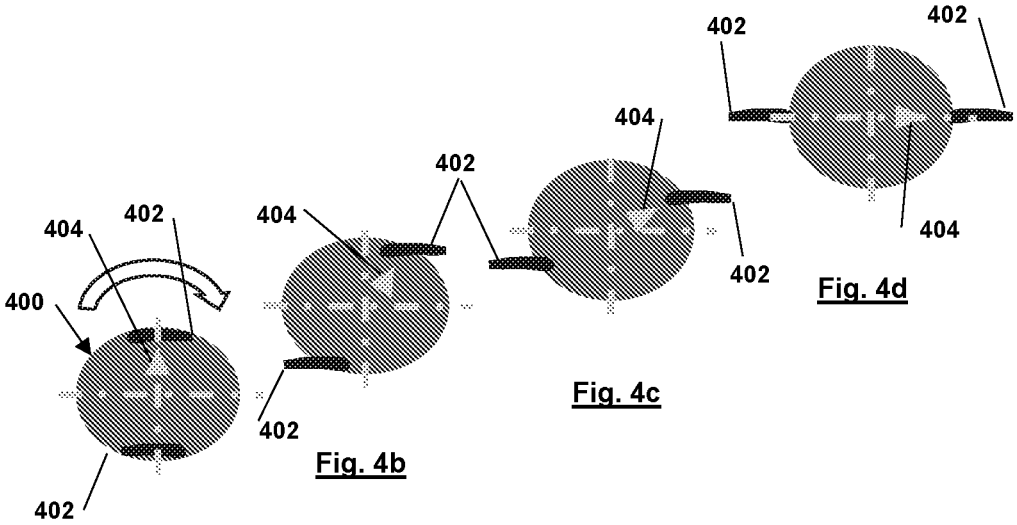
FIGS. 4*a*-4*g* illustrate a deployment of intermittently deployed control surfaces during half of the spin cycle.
Figures 4E, 4F, 4G:
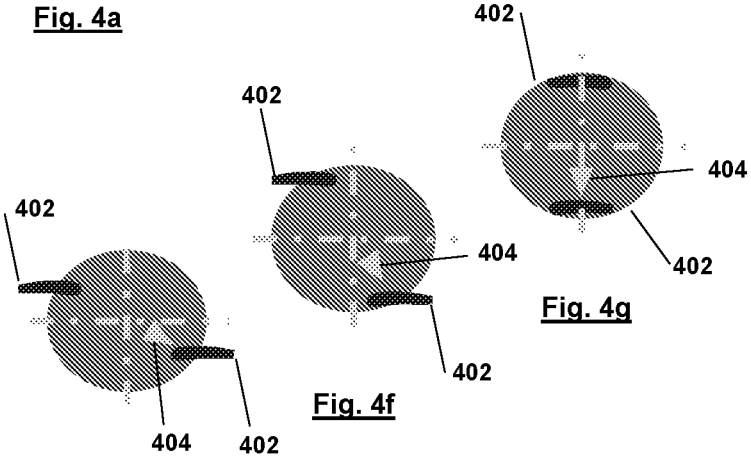

The first capability is related to the provision of the means of keeping the deployed control surfaces as close to their optimal lift generation direction as possible. For maximum effectiveness during each cycle of deployment, the control surfaces must obviously also be deployed during as much of the spin cycle as possible. For example, if the desired direction of the lift is in the vertical direction, then the control surfaces are desired to stay as close to a horizontal plane as possible during their entire period of deployment which is also desired to be as large a portion of the full spin (roll) cycle as possible. Such an intermittently deployed control surface feature is shown in the longitudinal view of a spinning round 400 shown in FIGS. 4*a*-4*g*. In FIGS. 4*a*-4*g*, the round position from its initial position in FIG. 4*a* is shown where the control surfaces 402 are fully retracted. This roll position of the clockwise rotating round is marked by the indicated triangle 404. As can be seen, during the entire deployed phase from FIG. 4(*a* to FIG. 4*g*, which corresponds to half of round spin (roll) cycle, the control surfaces 402 stay in the indicated horizontal (or whatever prescribed) plane, thereby keeping the direction of the lift vector fixed, i.e., upward in the case of FIGS. 4*a*-4*g*.

In the schematics of FIGS. 4*a*-4*g*, the control surfaces 402 are shown to begin to continuously deploy from the indicated position in FIG. 4*a*, becoming fully deployed after 90 degrees of spin (roll) as indicated in the position in FIG. 4*d*. The control surfaces 402 are then continuously retracted from the position in FIG. 4*d*, until after another 90 degrees of roll, the control surfaces 402 are fully retracted as shown in the position in FIG. 4*g*. Then during the remaining 180 degrees of roll from the position shown in FIG. 4*g* to that of FIG. 4*a*, the control surfaces 402 remain retracted. It is noted that while deployed, the control surfaces 402 undergo their motion while staying parallel to the prescribed direction to keep the generated lift is at its maximum and in the prescribed upwards direction.

The second capability is related to the provision of the means to vary the control surface pitch angle to make it possible to provide a continuously varying lift, i.e., control action, for the guidance and control system.

To make intermittently deployable control concepts suitable for high spin rounds, such as those with spin rates of up to 200 Hz and even higher, a further and important feature would be the capability to deploy the control surfaces during one cycle of roll and skipping one or more cycles of the roll. This capability would provide the means to run the control surface deployment mechanism at speeds that are significantly lower than the spin rate of the round and would thereby allow higher spin rates to be accommodated.

Another general feature that is desirable for almost all intermittently deployable control surface base control action devices for guidance and control of high spin rounds is their capability of being driven by electric motors at lower speeds than the round spin rate and that they should run at relatively constant speed to minimize their power requirement.

In addition, almost all intermittently deployable control surface base control action devices for guidance and control of high spin rounds must be capable of being activated as well as deactivated at the desired time during the flight.

Figure 5:
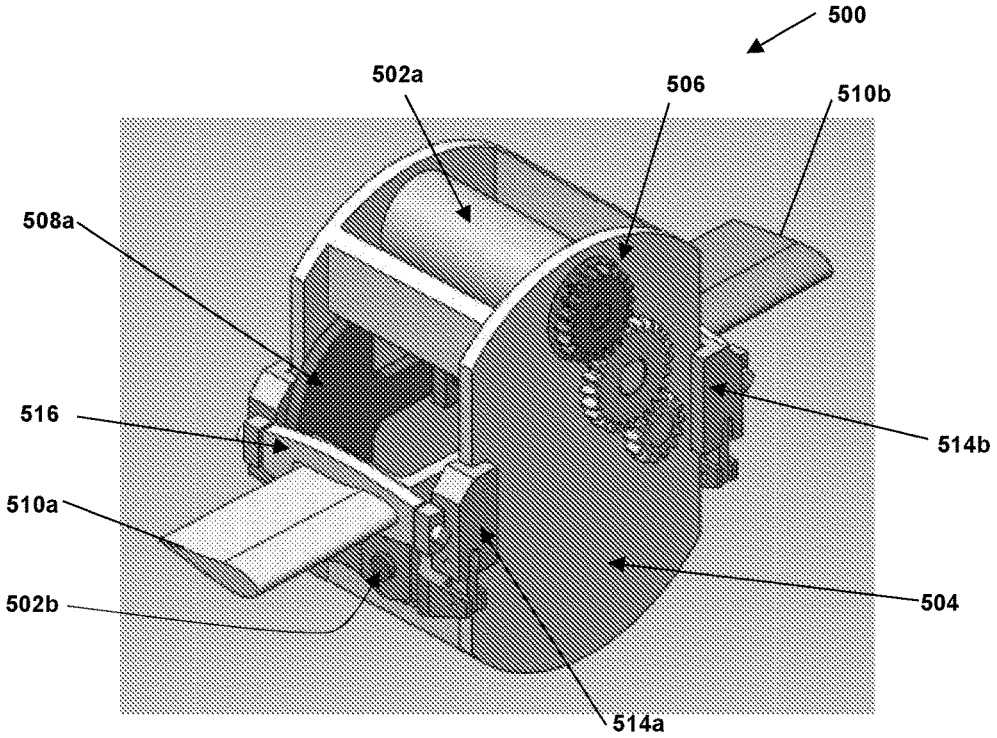
FIG. 5 illustrates an isometric view of the double-crank intermittently deployed control surface actuator for guidance and control of high speed guided and smart munitions.

In the following section, a detailed design of several intermittently deployable control surface devices for guidance and control of high speed rounds are presented. Such devices are those with the highest potential for successful development for the indicated ranges of spin rates. The specific features of each design that might make them more suitable for different caliber guided munitions and the results of calculations of their performance are also presented and their general size and volume requirements are also provided. Double-Crank Operated Intermittently Control Surface Deploying Mechanism A design of the first intermittently deployed control surface based actuation device for guidance and control of high spin rounds is shown in the FIGS. 5 and 6, generally referred to by reference numeral 500. In FIG. 5 an isometric view of the device 500 is shown with all its covers removed to show the internal components of the device. The structure of the device is considered to be an integral part of the intended high spin stabilized projectile body. The indicated control surface driving motor 502*a* and pitch control mechanism driving motor 502*b* are both double shaft motors that are attached to the structure (body) 504 of the spinning round. One shaft of the control surface drive motor is attached through the indicated set of driving gears 506 to the crankshaft 508*a* that deploys one control surface 510*a* and the other shaft to the crankshaft 508*b* that deploys the opposite control surface 510*b*. The pitch control motor 502*b* also has a double shaft and is used to rotate the pitch control mechanism arms 512*a*, 512*b*, FIG. 6, which would in turn translate upward the corresponding pitch control mechanism link 514*a*, 514*b* on one side of the control surface orientation holding mechanism 516 and downward the control surface orientation holding mechanism 516 on the other side of the control surface orientation holding mechanism 516, FIG. 5, thereby providing the means to vary the pitch of both control surfaces 510*a*, 510*b*.

The operation of the control surface deployment and retraction mechanism for a munition 700 is here described using the kinematic diagram of the mechanism shown in FIGS. 7*a*-7*f*. The mechanism is shown to be a five-bar linkage mechanism with a cam 702 that is used to reduce its degrees-of-freedom from two to one, while forcing the control surfaces 704 to move in parallel during the spin (roll) cycle of the round 700 (as shown schematically in FIGS. 4*a*-4*g*). In the kinematic diagram of FIGS. 7*a*-7*f*, the deployment and retraction mechanism of only one of the control surfaces 704 is shown in different positioning of the input crank, which is driven by the indicated driving motor and its gearing (see FIG. 5).

Figure 7A:
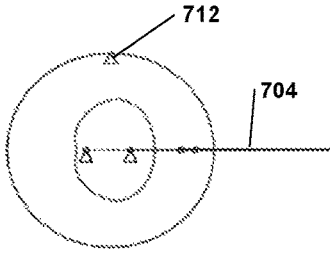
FIGS. 7*a*-7*f* illustrate the control surface deployment and retraction linkage mechanism with parallel link orientation retainment cam.
Figure 7B:
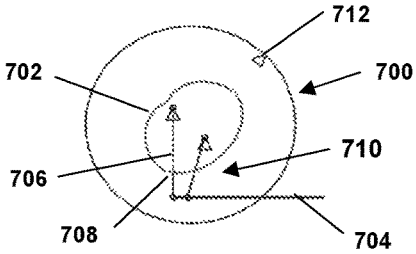
Figure 7C:
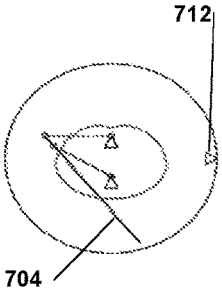
Figure 7D:
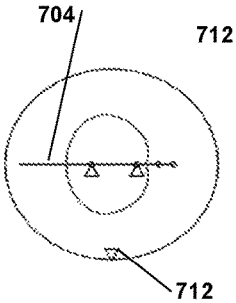
Figure 7E:
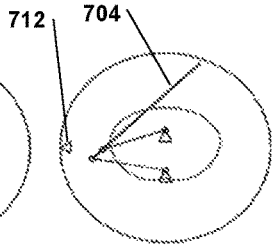
Figure 7F:
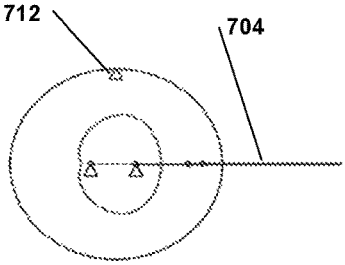

As can be seen in view FIG. 7*b*, the control surface linkage deployment and retraction mechanism is a "four-bar" linkage with one of the grounded links varying as the opposite grounded link is driven by the electric motor attached to the round 700. Here, the ground is intended to indicate the structure (spinning body) of the round. In this mechanism, as the said length varying link 706 rotates relative to the round, the control surface orienting cam 702, which is fixed to the round, will force the indicated cam follower 708 to vary the length of the link, thereby causing the coupler link 710 to which the control surface is attached to rotate. In this mechanism, the control surface orienting cam 702 profile is designed such that as the round rolls, the deployed control surface, i.e., the coupler link 710 of the "four-bar" linkage, translate in parallel, thereby be oriented as was shown in FIGS. 4*a*-4*g*. The control surface orientation while retracted is arbitrary and is designed to minimize dynamic forces acting on the mechanism to allow higher speed motions. In FIGS. 7*a*-7*f*, the provided triangle 712 is considered to be fixed to the round. The configuration of the fully deployed control surface is shown in FIG. 7*a*. Then as the round rotates 45 degrees, FIG. 7*b*, the control surface 704 is continuously retracted while the cam mechanism forces the control surface 704 to undergo parallel translation. The control surface 704 is then fully retracted, FIG. 7*c*, as the round spins from 45 to 90 degrees roll angle. The control surface 704 will then continue its motion inside the round from 90 to 270 degrees roll angle, FIGS. 7*c* through 7*e*, respectively, and then begins to be oriented parallel to its deployed orientation, FIGS. 7*a* and 7*f*, and around 325 degrees roll angle it begins to be deployed while staying parallel to its desired deployed orientation of FIGS. 7*a*, 7*b* and 7*f*.

Figure 6:
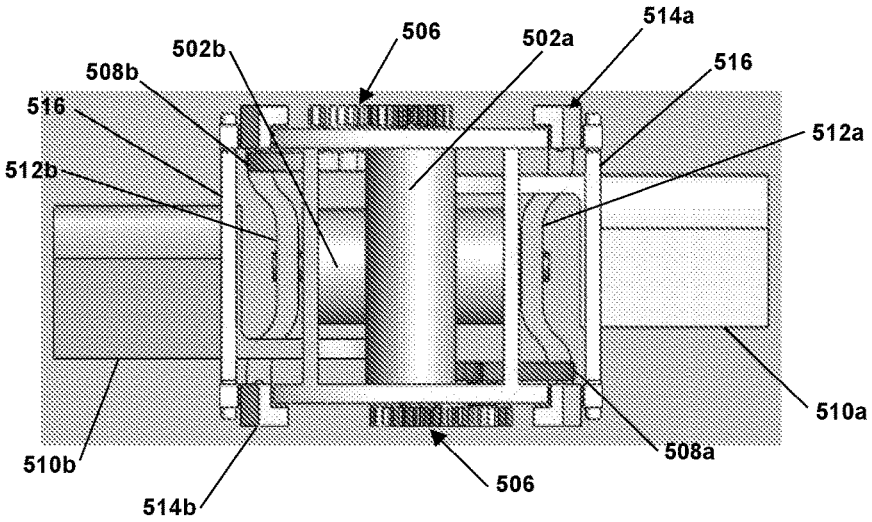
FIG. 6 illustrates a side view of the double-crank intermittently deployed control surface actuator for guidance and control of high speed guided and smart munitions of FIG. 5.

It is noted that several different implementations of the basic intermittently deployed control surface actuation devices shown in FIGS. 5 and 6 are possible and optimal for different caliber munitions and spin rate. The design shown in FIGS. 5 and 6 is developed for 81 mm rounds and can therefore be readily scaled to the munitions caliber. This design is not suitable for medium caliber rounds without major modifications.

Double-Cam Operated Intermittently Control Surface Deploying Mechanism

Figure 8:
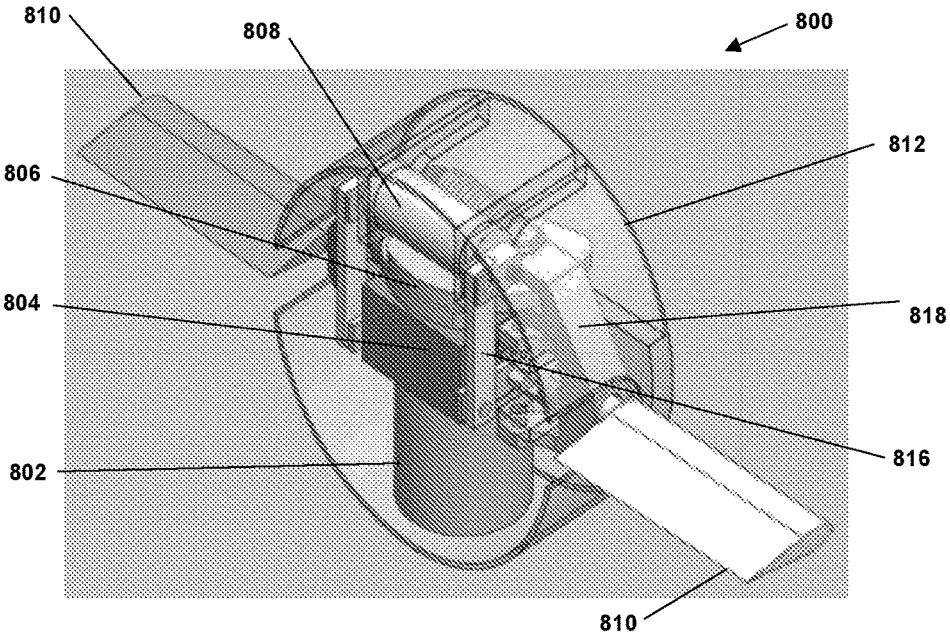
FIG. 8 illustrates isometric view of the double-cam operated intermittently deployed control surface actuator for guidance and control of high speed guided and smart munitions.
Figure 9:
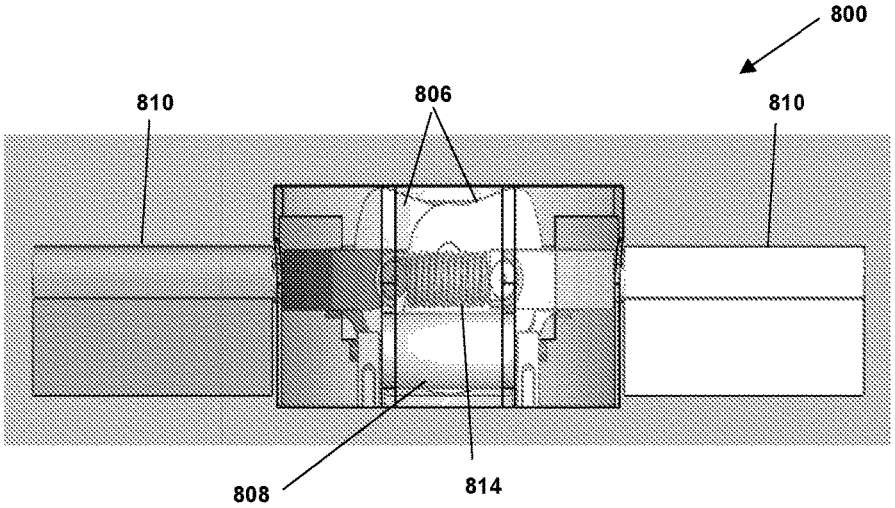
FIG. 9 illustrates side view of the intermittently deployed control surface actuator of FIG. 7.

The design of the second intermittently deployed control surface based actuation device for guidance and control of high spin rounds is shown in the solid model views of FIGS. 8 and 9, generally referred to by reference numeral 800. In FIG. 8 an isometric view of the device is shown with all its covers and shell structure either removed or are made transparent to show the internal components of the device. The structure of the device is considered to be an integral part of the intended high spin stabilized projectile body. The indicated control surface driving motor 802 drives a gear box 804 which would in turn drive two control surface deployment cams 806 via double counter-rotating inner and outer shafts. In a more compact design, the cams are mounted on the same gearbox shaft and the profile of the follower section of the rotating control surfaces are designed to achieve the same control surface motion. The pitch control mechanism driving motor 808 is a double shaft motor which is used to simultaneously vary the control surface pitch angles of both control surfaces 810 to achieve a smooth and symmetrically operating mechanism. Both said motors and gear box are attached to the structure (body) 812 of the spinning round.

Figure 10A:
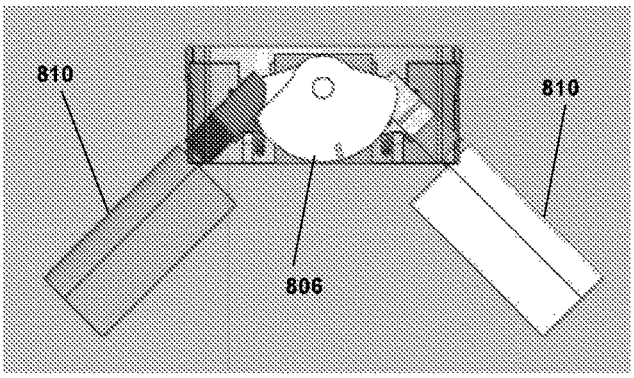
FIGS. 10*a* and 10*b* illustrate side views of the intermittently deployed control surface actuator of FIGS. 8 and 9 as partially and fully retracted by the device cams.
Figure 10B:
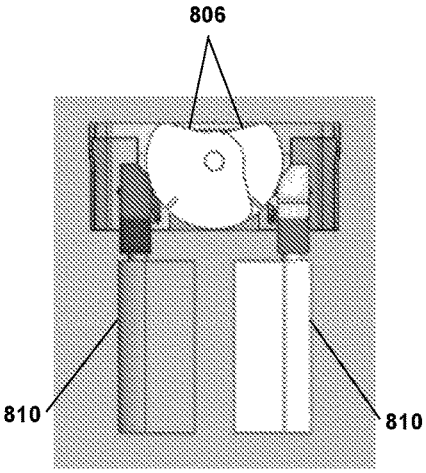

In the intermittently deployable control surface concept of FIGS. 8 and 9, the mechanism cams 806 are used to retract the control surfaces 810 while a spring 814 is used to simultaneously deploy the control surfaces 810. In FIGS. 10*a* and 10*b*, the control surfaces are shown as they are partially and fully retracted by the aforementioned cams 806, respectively.

The pitch control motor 808 is used to rotate the input link of the pitch control linkage 816, FIG. 8, which is effectively a four-bar linkage mechanism, which would in turn rotate a rotating shaft of the control surface 810 to vary its pitch. The control surface shaft is connected to the control surface deployment arm 818 via a swivel joint to allow it to rotate to deploy and retract, as well as rotate (about a perpendicular direction) for pitch angle adjustment.

It is noted that in the intermittently deployed control surface mechanism of FIGS. 8-10*a* and 10*b*, the mechanism cams are used to retract the control surfaces while the indicated spring element is used to rapidly deploy the control surfaces. It is obvious that the role of these elements can be reversed, i.e., the cams may be used to deploy the control surfaces and the spring to retract them.

It is noted that in the intermittently deployed control surface mechanism of FIGS. 8-10*a* and 10*b* and clearly observed in FIGS. 10*a* and 10*b*, during each roll (spin) cycle of the round, the control surfaces are deployed and retracted once. This means that the control surface driving cams have to rotate at the same speed as the round spin rate. However, by providing multiple deploy/retract profiles on the control surface retract/deploy cams, the required speed of the cams can be proportionally reduced. For example, by providing three such deploy/retract profiles on the control surface retract/deploy cams, the required rotational speed of the cam will be reduced by a factor of three, thereby making the mechanism suitable for higher spin rate munitions. It is noted that the function of the gearbox is to lower the required motor speed. Therefore at relatively low spin rates (order of 40-50 Hz), the gearbox can be eliminated and the cams can be driven directly by the control surface driving motor.

Figure 11A:
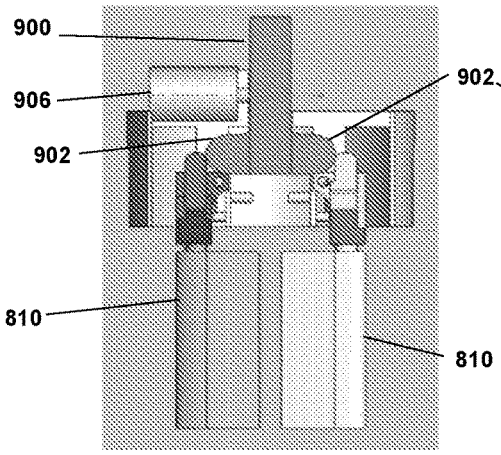
FIGS. 11*a* illustrates a side view of the first alternative cam operated intermittently deployed and retracting control surface actuator (left) and FIG. 11*b* illustrates an isometric view of the double sided cam.
Figure 11B:
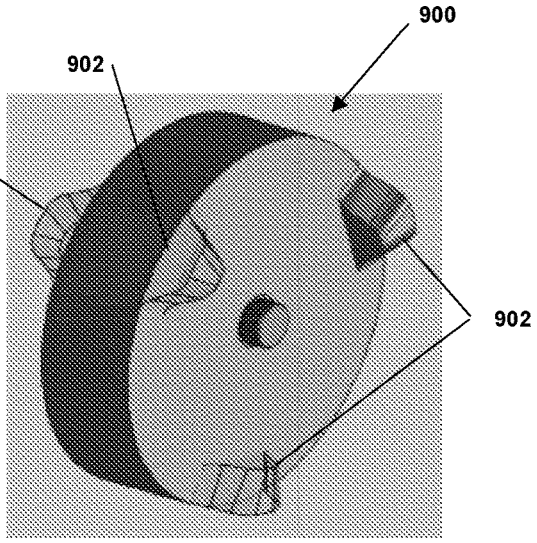
Figure 12:
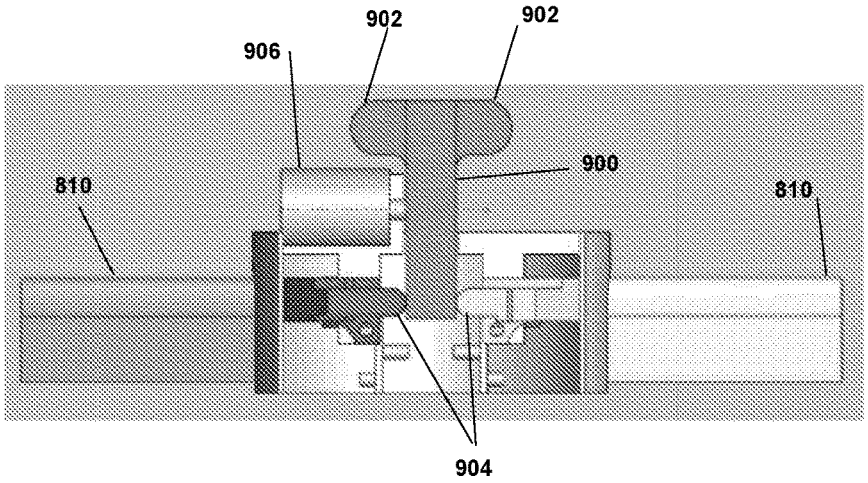
FIG. 12 illustrates side view of the deployed control Surfaces.

It is noted that different implementations of the basic intermittently deployed control surface actuation devices shown in FIGS. 8-10*a* and 10*b* are possible and optimal for different caliber munitions and spin rate. The design shown in FIGS. 8-10*a* and 10*b* is developed for 81 mm rounds and can therefore be readily scaled up to larger caliber munitions or down to medium caliber munitions. This design concept allows for longer control surfaces and due to its mode of operation, it can be readily adapted for use in medium caliber spinning rounds. Two such modified versions of the intermittently deployed control surface actuation devices, one more suitable for larger caliber and one more suitable for medium caliber rounds are disclosed next. First alternative cam-operated intermittently deploying control surface mechanism In this alternative cam operated mechanism for intermittently deploying control surfaces, all features of the design are identical to those of the design shown in FIGS. 8-10*a* and 10*b*, except for the design of its deployment and retraction cam mechanism which is shown in FIGS. 11*a*, 11*b* and 12. In the side view of FIG. 11*a*, the control surface deploying and retracting cam disc 900 is shown to be provided with a single pair of control surface cams 902, which in this configuration is positioned between the control surface lever followers 904, forcing them into retracted configuration. Then as the cam disc driving motor 906 rotates the cam disc 900 further, the pair of control surface cams 902 (see FIG. 11*b* right) are rotated out of engagement with the control surface lever followers 904, and the control surface deploying spring (814 FIG. 9) would rapidly deploy the control surfaces 810 as shown in the side view of FIG. 12. The control pitch angle adjustment mechanism is identical to the concept presented in FIGS. 8 and 9.

In the isometric view of FIG. 11*b*, the cam disc 900 is provided with three pairs of control surface cams 902. By using such a cam disc instead of the its one cam pair of version of FIG. 11*a*, during each three cycles of spin, the cam disc 900 has to rotate only once. This means that the cam disc driving motor 906 speed would need to be one-third of that of the round spin rate. Obviously by increasing the number of pairs of control surface cams 902, the required rotary speed of the cam disc 900 and its driving electric motor 906 can be proportionally further reduced.

Second Alternative Cam-Operated Intermittently Deploying Control Surface Mechanism In this alternative cam operated mechanism for intermittently deploying control surfaces, all features of the design are identical to those of the preliminary design shown in FIGS. 8-10*a* and 10*b*, except for the design of the deployment and retraction cam mechanism. This control surface deployment and retraction mechanism is shown in FIGS. 13*a*, 13*b* and 14.

Figure 13A:
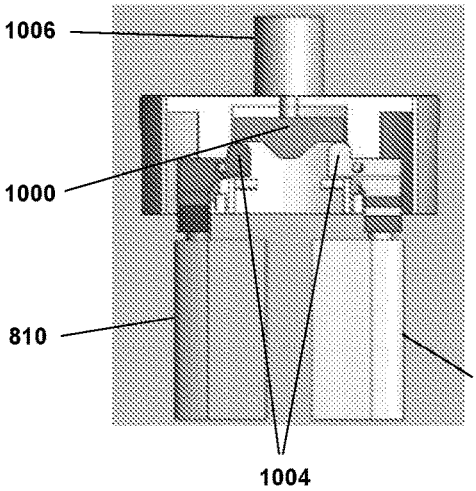
FIG. 13*a* illustrates a side view of the second alternative cam operated intermittently deployed and retracting control surface actuator and FIG. 13 *b* illustrates an isometric view of the cams.
Figure 14:
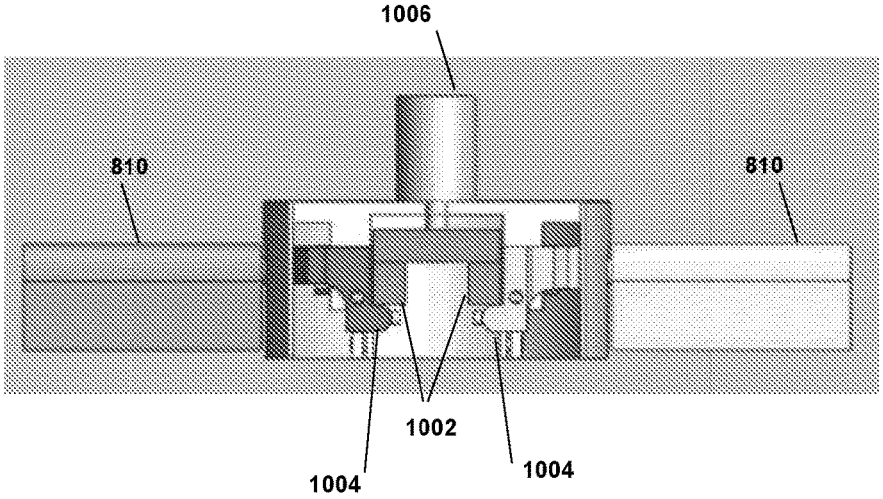
FIG. 14 illustrates a side view of the control surfaces deployed by the pair of cam surfaces provided on the rotating cam disc (FIG. 13—left).

In the side view of FIG. 13*a*, the control surface deploying and retracting cam disc 1000 is shown to be provided with a single pair of control surface cams 1002, which in this configuration is shown to be positioned 90 degrees away from the control surface lever followers 1004. In this design, the control surface deploying cams 1002 provide the means to deploy retracted control surfaces 810 as shown in FIG. 14. Here as the cam disc driving motor 1006 rotates the cam disc 1000 further, the pair of control surface deploying cams 1002 engage the control surface lever followers 1004, and cause them to rotate and deploy the control surfaces 810. In this design, the control surface deploying spring 814 of FIG. 9 has the function of providing the required retracting forces.

Figure 13B:
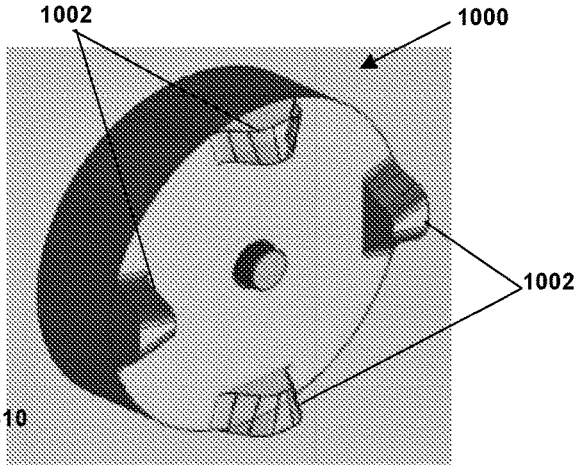

In FIG. 13*b*, the cam disc 1000 is shown with two pairs of control surface cams 1002. By using such a cam disc instead of the one with only one pair of control surface cams shown in the side view of FIG. 13*a*, during each two cycles of round spin, the cam disc 1000 has to rotate only once. This means that the cam disc driving motor 1006 speed would need to be one-half of that of the round spin rate. Obviously by increasing the number of pairs of control surface cams 1002, the required rotary speed of the cam disc 1000 and its driving electric motor 1006 can be proportionally further reduced. The pitch angle varying mechanism is identical to the concept of FIGS. 8 and 9.

Cam-Mechanism Operated Intermittently Deploying Control Surface Concept

Figure 15:
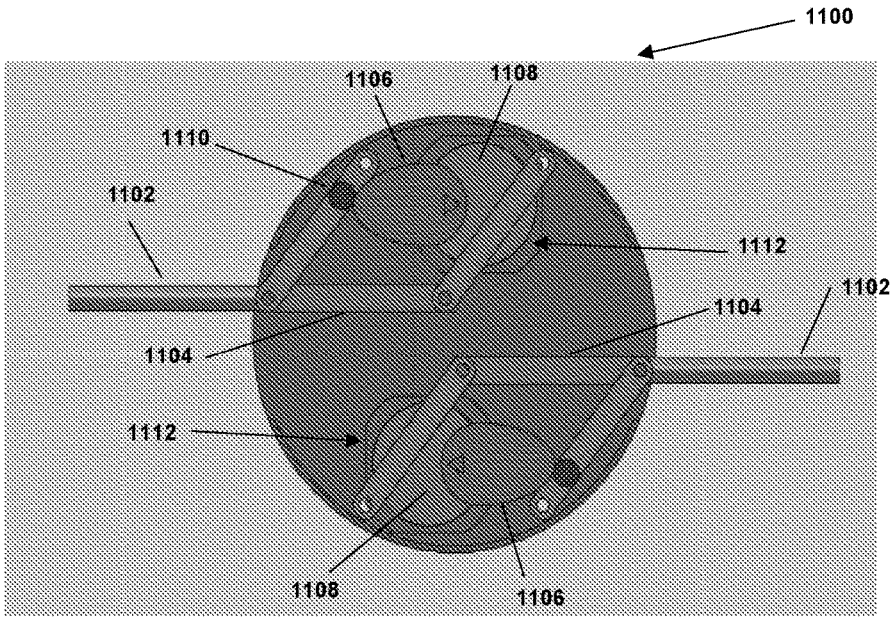
FIG. 15 illustrates a frontal view of the cam-mechanism operated intermittently deployed and retracted control surface actuator in deployed configuration.

The basic design of this intermittently deployed control surface based actuation device for high spin rounds is shown in the frontal view of FIG. 15, generally referred to by reference numeral 1100. In this design, the deploying control surfaces 1102 are driven by a four-bar linkage mechanism. The mechanism of keeping the control surfaces 1102 oriented for parallel motion as the round 1100 rolls is as shown in FIGS. 4*a*-4*g* is not shown but is designed to rotate the control surfaces 1102 which are hinged to the coupler link 1104 via a cam 1106 fixed to one of the grounded links. The pitch control is also achieved using a mechanism similar to the mechanism shown in either FIGS. 4*a*-4*g* or FIG. 8. One control surface deployment mechanism assembly is used for each control surface 1102.

It is noted that in this design concept, the planetary gear 1108 and driving motor assembly is connected to the round structure. In addition, the control surfaces 1102 are deployed from the same site at all times, thereby the size of the opening on the round becomes small. In the concept of FIG. 15, each planetary gear 1108 rotated cam 1106 is used to push against the indicated follower 1110 mounted on the indicated mechanism link. The resulting "outward" rotation of the link 1112 will then deploy the control surface 1102 while the round is at the desired roll angle. The retraction of the link is achieved by the pulling of the provided preloaded tensile springs (not shown for clarity).

One of the main advantages of this concept is that the deploying cam profile can be designed to work with the selected gear ratio of the planetary gear such that after several full spin cycles the control surfaces are deployed only once. Such a design makes it possible to accommodate very high spin rates. For example, if the mechanism is designed to deploy and retract the control surfaces once every four full spin cycles of the round, then the deployment and retraction drive has to run at one-fourth of the spin rate. For example, if the round is spinning at 200 Hz, then the electric motor driving the control surface deployment and retraction system has to operate at 50 Hz, which is considerably easier to achieve.

Figures 16A, 16B, 16C, 16D, 16E:
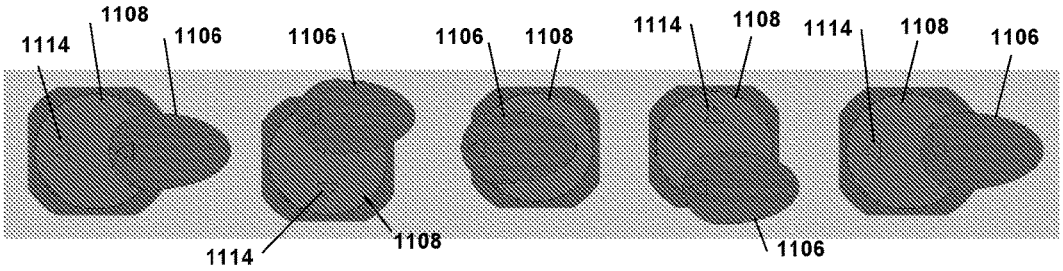
FIGS. 16*a*-16*e* illustrate the deployment and retraction cam motion during four full spin cycles of the round and one rotation cycle of the arm of the driving planetary gear.

In the present disclosure, such a control surface deployment and retraction mechanism can be designed in which during four full spin cycles of the round the control surfaces are deployed only once. The control surface deployment cam 1106 and its planetary gearing 1108 is shown in FIGS. 16*a*-16*e*. The driving motor is considered to be driving at one-fourth the spin rate and is driving the planetary gear arm 1108. The triangular marking 1114 on the planetary gear arm 1108 shows its orientation relative to an observer on the ground. In the position of FIG. 16*a*, the planetary gear arm 1108 is shown to be positioned with its triangular marking 1114 pointing to the left. Then after one full spin cycle of the round (i.e., after the round has rolled 360 degrees), the planetary gear arm rotation at one-fourth of the spin rate has turned 90 degrees as shown in the FIG. 16*b*. At this point, the cam 1106 has been retracted (from the control surface deployed position shown in FIG. 15 i.e., from FIG. 16*a*). After a second full spin cycle of the round, the planetary gear arm 1108 has rotated 180 degrees, FIG. 16*c*, and after another full spin cycle, the planetary gear arm has rotated 270 degrees, FIG. 16*d*. Then during the next spin cycle of the round, at some point the cam will begin to deploy the control surface 1102, reaching at its full deployed position after the first full rotation of the planetary gear arm 1108 has been completed as shown in the FIG. 16*e*. The control surface 1102 will then begin to be retracted as the round begins to undergo its next full cycle.

Figure 17:
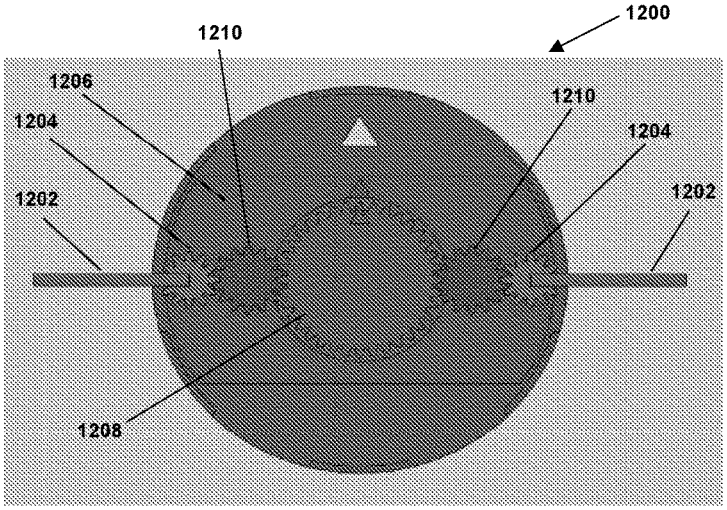
FIG. 17 illustrates a frontal view of the fixed gear driven intermittently deployed and retracted control surface actuator in deployed configuration.

Fixed Gear with Driven Platform with a Double-Gear Train Control Surface Deployment and Retraction Mechanism The basic design of this intermittently deployed control surface based actuation device for guidance and control of high spin rounds is shown in the frontal view of FIG. 17, generally referred to by reference numeral 1200. In this design concept, the deploying and retracting control surfaces 1202 are attached to the outer gears (pinions) 1204 that are mounted on a motor driven gear platform 1206. The control surface pinions 1204 are engaged with the main gear 1208 via idler gears 1210 as shown in FIG. 17. The main gear 1208 is fixed to the round and as a result with the selected gear ratios, the control surfaces 1202 always exit from the provided openings in the round shell. In this section, the mechanism of keeping the control surfaces oriented to undergo parallel motion as the round rolls as shown in FIGS. 4*a*-4*g* is not shown for the sake of saving space but is designed to rotate the control surfaces 1202 which are hinged to the outer pinions 1204 via cams driven by the idler gears 1210. The pitch control is also achieved using a mechanism similar to the mechanism shown in either FIGS. 4*a*-4*g* or FIG. 8.

There are two features of this design that makes it suitable for high spin round applications. Firstly, since the main gear 1208 is fixed to the round, with proper gear ratios, the control surfaces 1202 deploy at the same location on the round, requiring small openings for deployment. Secondly, similar to the previous section, with properly selected gear ratios, after several full spin cycles of the round, the control surfaces are deployed only once. Such a design will similarly make it possible for the present mechanism to accommodate very high spin rates.

In the disclosure, the gear ratio of the control surface deployment and retraction mechanism was selected for control surfaces to deploy once during each two spin cycles of the round. The control surface deployment cycle during one full cycle of spin is shown in FIGS. 18*a*-18*e*. The driving motor is considered to be driving the gear platform at half the spin rate. The triangular markings on the main gear and the gear platform show their relative position.

Figures 18A, 18B, 18C, 18D, 18E:
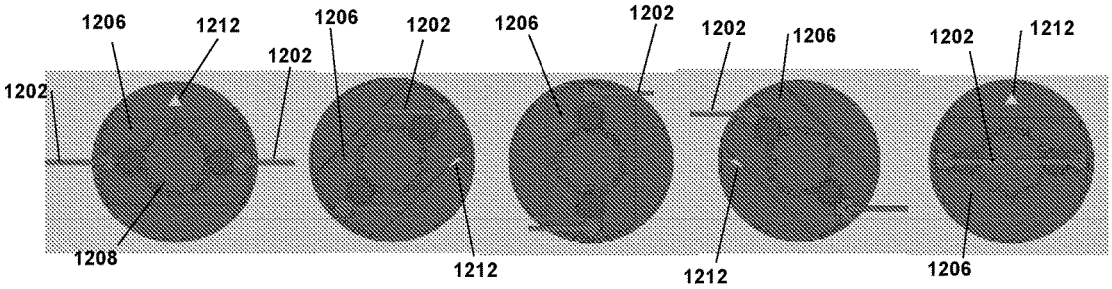
FIGS. 18*a*-18*e* illustrates a control surface deployment and retraction cycle during one full spin cycle of the round and corresponding one-half rotation cycle of the gear platform.

In FIG. 18*a*, the gear platform 1206, the round (and its attached main gear 1208) are shown in their indicated positioned by triangular marking 1212, all pointing upwards. Then after 90 degrees of spin shown in the FIG. 18*b*, the control surfaces 1202 are withdrawn and the gear platform 1206 has been rotated 45 degrees relative to the main gear 1208 (and round). After 180 degrees rotation of the round, FIG. 18*c*, the gear platform 1206 has rotated only 90 degrees relative to the main gear 1208. After 270 and full roll of the round shown in FIGS. 18*d* and 18*e*, the gear platform 1206 is shown to have rotated 135 and 180 degrees, respectively. As a result, during one full spin cycle, the gear platform 1206 and its driving motor has made only half a turn. It is noted that the control surface orienting cam will prevent deployment of FIGS. 18*c*-18*d*, thereby ensuring that during each two full spin cycles of the round, the control surfaces 1202 are deployed and retracted only once.

Figure 19:
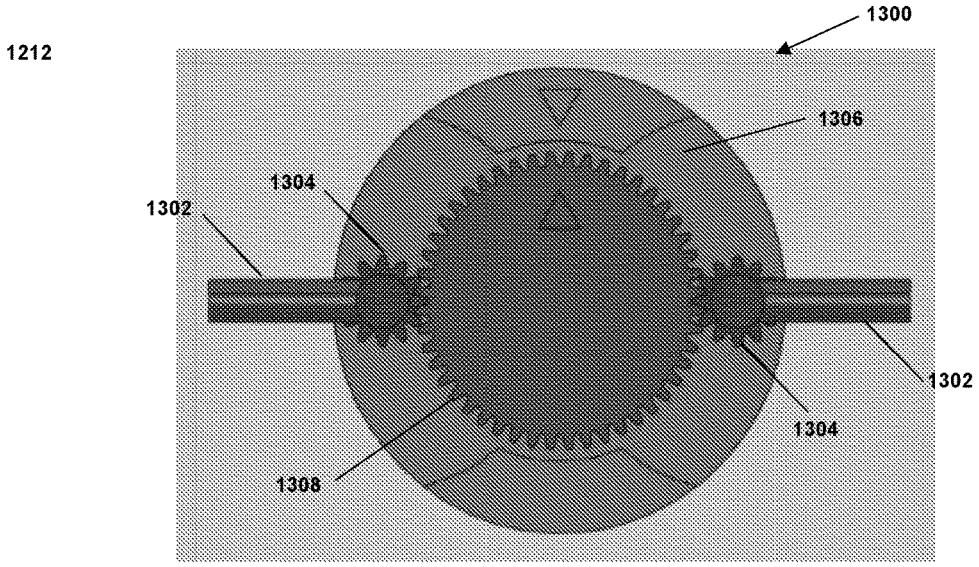
FIG. 19 illustrates a frontal view of the gear-pinion driven intermittently deployed and retracted control surface actuator in deployed configuration.

Gear Driven Mechanism with Round-Fixed Pinions for Control Surface Deployment and Retraction The basic design of this intermittently deployed control surface based actuation device for guidance and control of high spin rounds is shown in the frontal view of FIG. 19, generally referred to by reference numeral 1300. In this design concept, the deploying and retracting control surfaces 1302 are attached to the gears (pinions) 1304 that are mounted onto the round structure 1306, thereby ensuring that the control surfaces 1302 deploy through the same opening area of the round at all times. The control surface pinions 1304 are engaged with the main gear 1308 which is driven by a motor attached to the round structure 1306. The gear ratio between the main gear 1308 and the pinions 1304 determines the number control surface deployment per cycles of round spin. In the example shown in FIG. 19, the gear ratio results in one cycle of control surface deployment per four cycles of round spin. As a result, the main gear 1308 has to be driven at one-fourth of the spin rate. Here, the mechanism of keeping the control surfaces 1302 oriented to undergo parallel motion as the round rolls as shown in FIGS. 4*a*-4*g* is not shown for saving space but is designed to rotate the control surfaces 1302 which are hinged to the pinions 1304 via cams also driven by the main gear. The pitch control is also achieved using a mechanism similar to the mechanism shown in either FIGS. 4*a*-4*g* or FIG. 8.

This concept also enjoys the two features of the previous concept, making it suitable for high spin round applications. Firstly, since the control surface gear 1304 is fixed to the round, the control surfaces 1302 always deploy at the same location on the round, thereby requiring small openings for control surface deployment. Secondly, by proper selection of the gear ratio, after several full spin cycles of the round, the control surfaces 1302 are deployed only once. Such a design will similarly make it possible for the present mechanism to accommodate very high spin rates.

In the disclosure, the gear ratio of the control surface deployment and retraction mechanism can be selected such that the control surfaces 1302 are deployed once every four spin cycles. The control surface deployment cycle during one full cycle of spin is shown in FIGS. 20*a*-20*e*. The driving motor is driving the main gear 1308 at one-fourth of the spin rate. The triangular marking 1310 on the main gear 1308 and the triangular marking 1312 on the round show their relative position as the round rolls.

Figures 20A, 20B, 20C, 20D, 20E:
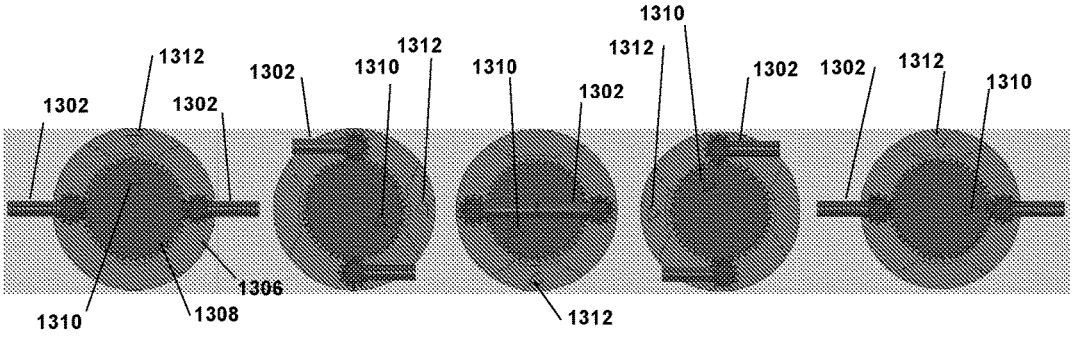
FIGS. 20*a*-20*e* illustrate a control surface deployment and retraction cycle during one full spin cycle of the round and corresponding 90 degrees rotation cycle of the main gear.

In FIG. 20*a*, the main gear 1308 and the round are in the positions indicated by the triangular markings 1310, 1312 (pointing upwards). Then after 90 degrees of spin, FIG. 20*b*, the control surfaces 1302 are withdrawn and the main gear 1308 has rotated 22.5 degrees relative to the round. After 180 degrees rotation of the round, FIG. 20*c*, the main gear 1308 has rotated 45 degrees relative to the round. After 270 and full roll of the round shown in FIGS. 20*d* and 20*e*, respectively, the main gear 1308 is shown to have rotated 67.5 and 90 degrees, respectively. As a result, during one full spin cycle, the main gear 1308 and its driving motor have rotated only 90 degrees or one quarter of a turn.

Novel Intermittently Deployable Drag Element Concepts for Guidance and Control

The intermittent control surface deployment mechanisms described in the previous section may also be used to deploy drag-based control elements in place of commonly used solenoids and voice coil motors with orders of magnitude increase in efficiency and dynamic response as well as with orders of magnitude reduction in power consumption due to the use of continuously rotating and balanced electric motors.

In general, only a single such drag deploying mechanism is needed in a round since it can be deployed at the required roll during each and every spin cycle or after one or more spin cycles depending on the design of the drag element and the amount of drag that it produces during each deployment. The shape and size and duration is dependent on the spin rate and size of the round and the amount of diverting drag force that is desired to be generated.

It is noted that as was described in the introduction section, drag element deployment based actuation guidance and control is generally not highly desirable for most munitions since it decreases the munitions range. However, in those applications in which the reduction in the range can be tolerated, then the methods and concepts described above may be used in place of the currently used methods to achieve highly efficient and low power drag based guidance and control action for high spin rounds.

The Novel Roll Angle Measurement Sensor

Polarized RF angular orientation sensors 1400, such as those disclosed in U.S. Pat. Nos. 8,587,473; 8,259,292; 8,258,999; 8,164,745; 8,093,539; 8,076,621 and 7,425,918 are constructed with geometrical cavities that operate with scanning polarized RF reference sources in a configuration shown in FIGS. 21*a* and 21*b*. In this sensory system, a polarized RF reference source transmits electromagnetic waves with polarization planes parallel to the $Y_{ref}Z_{ref}$ plane of the reference coordinate system $X_{ref}Y_{ref}Z_{ref}$. When the reference source is used to scan a prescribed pattern, the measured signal at the sensor cavity positioned, for example, on the base of the projectile, and the pattern of the signal provides the actual roll angle orientation of the sensor relative to the reference source onboard munitions (see indicated patents for detail).

Through modeling and computer simulation, anechoic chamber and range tests, such polarized RF sensory system allows the roll angle of high-spin rounds to be measured with high precision directly onboard munitions in line-of-sight as well as non-line-of-sight conditions. In general, due to symmetry in the propagated electromagnetic wave, "up and down" of the rolling projectile orientation cannot be differentiated. This issue can be readily resolved for spinning rounds as described below (see U.S. Pat. No. 8,587,473).

Figure 21A:
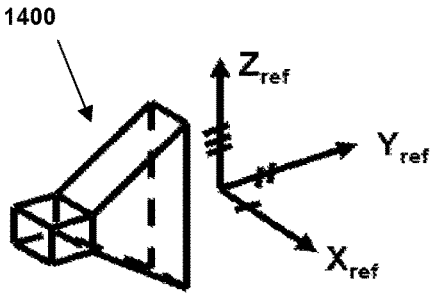
FIGS. 21*a* and 21 *b* illustrate opposing isometric views of a polarized RF sensor.
Figure 21B:
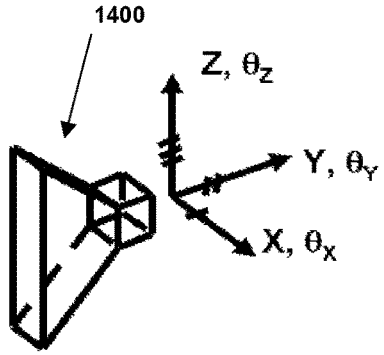
Figure 22A:
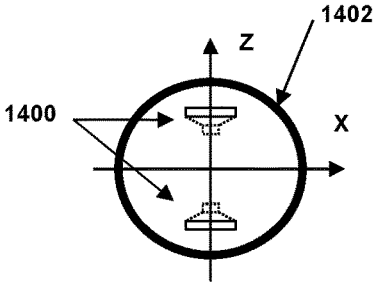
FIGS. 22*a* and 22*b* illustrate a back and side view, respectively, of the sensors of FIGS. 21*a* and 21*b* disposed on a munition.
Figure 22B:
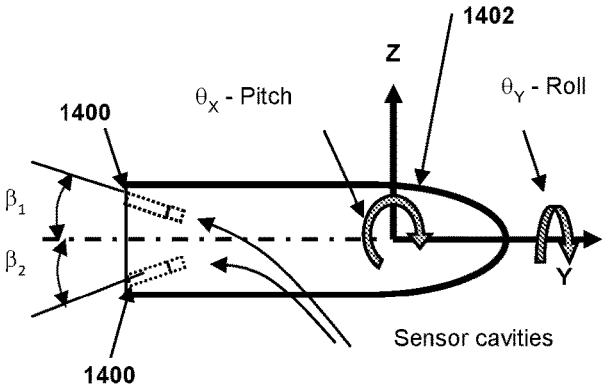

In the simplest concept, a polarized RF reference source transmits electromagnetic waves with polarization planes parallel to the $Y_{ref}Z_{ref}$ (i.e., the horizontal) plane of the Cartesian reference coordinate system $X_{ref}Y_{ref}Z_{ref}$ shown in FIGS. 21*a* and 21*b*. Two identical polarized RF cavity sensors 1400 are embedded into the projectile 1402 at angles $\beta_1$ and $\beta_2$ as shown in FIGS. 22*a* and 22*b*. Each one of the sensors 1400 can be used to measure the roll angle with an appropriately patterned scanning reference source, but without being able to differentiate "up and down" as previously indicated. However, since the reference source is on the ground, by making the angles $\beta_1$ and $\beta_2$ significantly different, at each of their horizontal roll angle positioning, the one that is more closely lined up with the direction of the reference source will receive larger amplitude signals. By comparing the relative amplitudes of the received signals, up and down orientation of the round in roll is thereby differentiated. In addition, since the actual angles (31 and 132 are known, the difference between the (average) magnitudes of the two measured signals would provide an indication of die projectile pitch angle.

Pulsed Actuation Impulse Magnitude and Dynamic Response

The actuations concepts, including the multi-stage slug-shot; multi-stage impulse thruster; and the intermittently deployed control surface actuation device concepts provide pulsed control action with very high dynamic response characteristics.

The multi-stage slug-shot and the multi-stage impulse thruster based control action producing devices for guidance and control of munitions are impulse producing actuation devices which are based on detonation of small charges that are initiated with highly reliable electrical initiators. The electrical initiators have been shown to be capable of providing detonation within 20-50 microseconds, thereby making them suitable for high spin munitions applications. The slug-shot impulse actuation providing around 10 N-sec with sub-millisecond durations have been designed and tested and with higher energy explosive charges are expected to provide significantly larger impulse and shorter duration, thereby considering that several of these impulses can be provided per second during each revolution of the munitions, it is obvious that these multi-stage pulsed actuation devices can readily be sized to provide the required impulses in the range of 10 N-sec to 140 N-sec. The multi-stage slug-shot and the multi-stage impulse thruster based control actions are suitable mainly for terminal guidance applications due to the limited number of units that can be provided on each round.

The intermittently deployed control surface based control actions for guidance and control of munitions can be readily sized to provide equivalent of 10-140 N-sec impulse levels and even significantly higher equivalent impulse levels for control action, particularly by providing them as canards. The quasi-continuous control action provided by such actuation concepts can be used a portion or the entire flight. The control action is also readily varied by varying the control surface pitch. The control surface based control actions are particularly suitable for longer range munitions since they would minimally affect range.

As it was previously discussed, the mechanisms used to intermittently deploy control surfaces can also be used to deploy drag elements to produce control action. In general, drag based control action would cause the munitions range to be reduced. However, in applications that such effects can be tolerated, one may also use the developed concepts to generate drag-based control action. In such applications, the pitch control mechanism may be used to vary the level of generated drag.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for deploying a control surface from an exterior surface of a spinning projectile during flight, the method comprising:

at least partially retracting the control surface into an interior of the projectile for a portion of a full revolution of the spinning projectile and extending the control surface from the interior of the projectile for another portion of the full revolution of the spinning projectile; and maintaining the control surface in one of a same plane or parallel to the same plane during the full revolution of the spinning projectile.

2. The method of claim 1, wherein the same plane is a horizontal plane relative to the ground.

3. The method of claim 1, wherein the control surface is fully retracted into the interior and fully extended from the interior one time for each full revolution of the spinning projectile.

4. The method of claim 1, wherein the control surface is fully retracted into the interior and fully extended from the interior one time for every n full revolutions of the spinning projectile, where n is an integer greater than 1.

5. The method of claim 1, wherein the control surface comprises two control surfaces, arranged 180 degrees apart relative to the spinning projectile, wherein:

each of the two control surfaces are at least partially retracted into the interior of the projectile for a portion of the full revolution of the spinning projectile and extended from the interior of the projectile for another portion of the full revolution of the spinning projectile; and each of the two control surfaces are maintained in the same plane during the full revolution of the spinning projectile.

6. The method of claim 1, wherein the control surface further pitches around a longitudinal axis of the control surface.

7. The method of claim 1, wherein the control surface moves from a retracted position to an extended position in translation.

8. The method of claim 1, wherein the control surface moves from a retracted position to an extended position in rotation.

9. A projectile comprising:

a body having an interior;

a control surface movable between a retracted position at least partially in the interior of the projectile to an extended position extending from an exterior surface of the projectile while the projectile is spinning;

means for at least partially retracting the control surface into the interior of the projectile for a portion of a full revolution of the spinning projectile and extending the control surface from the interior of the projectile for another portion of the full revolution of the spinning projectile and for maintaining the control surface in one of a same plane or parallel to the same plane during the full revolution of the spinning projectile.

10. The projectile of claim 9, wherein the control surface comprises two control surfaces, arranged 180 degrees apart relative to the body.

* * * * *